US010383357B2

(12) United States Patent
Bromberg et al.

(10) Patent No.: US 10,383,357 B2
(45) Date of Patent: Aug. 20, 2019

(54) SELECTIVE REDUCTION OF TOBACCO-SPECIFIC NITROSAMINES AND RELATED METHODS

(71) Applicant: Massachusetts Institute of Technology, Cambridge, MA (US)

(72) Inventors: Lev E. Bromberg, Salem, MA (US); Xiao Su, Cambridge, MA (US); Trevor Alan Hatton, Sudbury, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 50 days.

(21) Appl. No.: 15/592,160

(22) Filed: May 10, 2017

(65) Prior Publication Data

US 2017/0325495 A1 Nov. 16, 2017

Related U.S. Application Data

(60) Provisional application No. 62/333,907, filed on May 10, 2016.

(51) Int. Cl.
*A24B 15/22* (2006.01)
*A24B 15/24* (2006.01)

(52) U.S. Cl.
CPC ..... *A24B 15/245* (2013.01); *A24B 15/22* (2013.01)

(58) Field of Classification Search
CPC ..... A24B 15/245; A24B 15/22
See application file for complete search history.

(56) References Cited

U.S. PATENT DOCUMENTS 2,360,042 A 10/1944 Dearborn
3,317,607 A 5/1967 Latourette et al.
(Continued)

FOREIGN PATENT DOCUMENTS

CN 104223355 B 10/2015
CN 104262323 B 2/2016
CN 104351943 B 2/2016

OTHER PUBLICATIONS

International Search Report and Written Opinion dated Jul. 31, 2017 for Application No. PCT/US2017/032047.
(Continued)

*Primary Examiner* — Arun S Phasge
(74) *Attorney, Agent, or Firm* — Wolf, Greenfield & Sacks, P.C.

(57) ABSTRACT

Aspects of the present disclosure relate to electrochemical reduction of tobacco-specific nitrosamines (TSNAs). According to certain methods described herein, a tobacco composition containing one or more TSNAs and nicotine is contacted with a solvent to form a tobacco mixture. In some embodiments, the tobacco mixture is introduced into an electrochemical device comprising an anode and a cathode. The tobacco mixture may, in some cases, form at least part of an initial electrolyte mixture that is in physical contact with at least a portion of the anode and at least a portion of the cathode. In some instances, an electrical potential is applied between the anode and the cathode, thereby reducing one or more TSNAs in the initial electrolyte mixture and producing a reduced electrolyte mixture. In certain cases, application of the electrical potential between the anode and the cathode does not cause non-TSNA components of the tobacco mixture (e.g., nicotine) to undergo electrochemical reduction or any other chemical reaction.

20 Claims, 10 Drawing Sheets

(56) References Cited

U.S. PATENT DOCUMENTS 4,301,817 A * 11/1981 Keritsis ..... A24B 15/24 131/297
2016/0029689 A1 2/2016 Lang et al.

OTHER PUBLICATIONS

Chaplin et al., Electrochemical destruction of N-nitrosodimethylamine in reverse osmosis concentrates using boron-doped diamond film electrodes. Environ Sci Technol. Jun. 1, 2010;44(11):4264-9. doi:10.1021/es903872p.
Atalla et al., Carbonyl reduction of the tobacco-specific nitrosamine 4-(methylnitrosamino)-1-(3-pyridyl)-1-butanone (NNK) in cytosol of mouse liver and lung. Toxicology. Nov. 29, 1999;139(1-2):155-66.
Gray et al., The case of the disappearing nitrosamines: a potentially global phenomenon. Tobacco Control. 2004;13:13-16.
Hecht, It is time to regulate carcinogenic tobacco-specific nitrosamines in cigarette tobacco. Cancer Prev Res (Phila). Jul. 2014;7(7):639-47. doi: 10.1158/1940-6207.CAPR-14-0095. Epub May 7, 2014.
Hecht, DNA adduct formation from tobacco-specific N-nitrosamines. Mutat Res. Mar. 8, 1999;424(1-2):127-42.
Hecht, Tobacco carcinogens, their biomarkers and tobacco-induced cancer. Nat Rev Cancer. Oct. 2003;3(10):733-44.
Hoffmann et al., The changing cigarette: Chemical studies and bioassays. In: Shopland DR, ed. Risks Associated with Smoking Cigarettes with Low Machine-Measured Yields of Tar and Nicotine. Bethesda, MD: U.S. Department of Health and Human Services, National Institutes of Health, National Cancer Institute Smoking and Tobacco Control Monograph (NIH), No. 13. Ch. 5. 2001:159-192.
Jiang et al., Heat-treated hemin supported on graphene nanoplatelets for the oxygen reduction reaction. Electrochem Commun. 2012;19:73-76. Epub Mar. 15, 2012.
Jiang et al., Increasing the electrochemically available active sites for heat-treated hemin catalysts supported on carbon black. Electrochim Acta. 2012;75:185-90. Epub May 3, 2012.
Liang et al., Hemin: A highly effective electrocatalyst mediating the oxygen reduction reaction. J Phys Chem C. 2011;115(5):2604-10. Epub Jan. 7, 2011.
Maser et al., Carbonyl reduction of 4-(methylnitrosamino)-1-(3-pyridyl)-1-butanone (NNK) by cytosolic enzymes in human liver and lung. Cancer Lett. Feb. 1, 2000;148(2):135-44.
Urban et al., Quantitation of $N^1$-nitrosonornicotine (NNN) in smokers' urine by liquid chromatography-tandem mass spectrometry. J Anal Toxicol. Jun. 2009;33:260-65.
Wu et al., Simultaneous determination of five tobacco-specific nitrosamines in mainstream cigarette smoke by isotope dilution liquid chromatography/electrospray ionization tandem mass spectrometry. Anal Chem. 2003;75(18):4827-32. Epub Aug. 16, 2003.
Xi et al., Stability of hemin/C electrocatalyst for oxygen reduction reaction. Int J Hydrogen Energy. 2012;37:4606-11. Epub Jun. 14, 2011.
Xu et al., Covalent hybrid of hemin and mesoporous carbon as a high performance electrocatalyst for oxygen reduction. Int J Hydrogen Energy. 2012;37:15976-82. Epub Sep. 8, 2012.
International Preliminary Report on Patentability dated Nov. 22, 2018 for Application No. PCT/US 2017/032047.

* cited by examiner 3-(1-nitrosopyrrolidin-2-yl)pyridine (NNN)
m/z: 177.09 (100.0%), 178.09 (10.9%)

2-(pyridin-3-yl)pyrrolidin-1-aminium
m/z: 164.12 (100.0%), 165.12 (10.8%)

SELECTIVE REDUCTION OF TOBACCO-SPECIFIC NITROSAMINES AND RELATED METHODS

RELATED APPLICATION

This application claims priority under 35 U.S.C. § 119(e) to U.S. Provisional Patent Application Ser. No. 62/333,907, filed May 10, 2016, and entitled "Selective Reduction of Tobacco Specific Nitrosamines and Related Methods," which is incorporated herein by reference in its entirety for all purposes.

FIELD

The present invention generally relates to methods for reducing tobacco-specific nitrosamines.

BACKGROUND

Over a billion people in the world smoke or otherwise use tobacco products such as cigarettes, cigars, chewing tobacco, and snuff. These tobacco products generally contain tobacco-specific nitrosamines (TSNAs), which are typically formed during curing and/or processing of tobacco leaves. Since TSNAs have been linked to a variety of cancers in animals and humans, including oral, lung, esophageal, and pancreatic cancers, it would be desirable to reduce or eliminate TSNAs in tobacco products.

Although various treatments of tobacco plants and/or harvested tobacco leaves have been suggested to reduce TSNA levels, the suggested treatments are often associated with significant drawbacks. For example, one proposed treatment, which involves extracting a TSNA with a 0.1 N KOH solution, can introduce toxic compounds into tobacco. Another method for reducing TSNAs, which is described in U.S. Patent Publication No. 2016/0029689, involves heating tobacco material to a temperature of greater than 100° C. in the presence of a liquid or steam to release at least a portion of a TSNA from the tobacco material. While this method may be capable of partially reducing the amount of a TSNA in tobacco material, the method is cumbersome and can lead to extraction of water-soluble nicotine and unwanted reduction of its levels in the tobacco material. Further, TSNAs and other toxicants evaporated into the vapor phase can create an environmental hazard and require costly disposal measures.

Some of the suggested methods for reducing nitrosamine levels are particularly unsuitable for tobacco products containing nicotine. For example, U.S. Pat No. 3,317,607discloses the reduction of nitrosamines by treatment with a metal and an acid to form corresponding disubstituted hydrazines. Not only does the utilization of toxic metals render the disclosed method unsuitable for nitrosamine reduction in products intended for consumer use in general, but the disclosed method is particularly unsuitable for nicotine-containing tobacco products since the nicotine can form highly toxic complexes with the metals—such nicotine-metal complexes can be used as insecticides and fungicides and are inappropriate for consumer tobacco products.

Accordingly, improved methods for reducing TSNAs are needed.

SUMMARY

The present invention generally relates to methods for reducing tobacco-specific nitrosamines. The subject matter of the present invention involves, in some cases, interrelated products, alternative solutions to a particular problem, and/or a plurality of different uses of one or more systems and/or articles.

Some aspects relate to a method for reducing a tobacco-specific nitrosamine. In some embodiments, the method comprises contacting an initial electrolyte mixture with an anode and a cathode. In certain embodiments, the initial electrolyte mixture comprises nicotine, the tobacco-specific nitrosamine, a dissolved salt, and at least one solvent. In some embodiments, the method comprises applying an electrical potential between the anode and the cathode to form a reduced electrolyte mixture. In certain embodiments, a concentration of the tobacco-specific nitrosamine in the reduced electrolyte mixture is lower than a concentration of the tobacco-specific nitrosamine in the initial electrolyte mixture.

Other advantages and novel features of the present invention will become apparent from the following detailed description of various non-limiting embodiments of the invention when considered in conjunction with the accompanying figures. In cases where the present specification and a document incorporated by reference include conflicting and/or inconsistent disclosure, the present specification shall control.

BRIEF DESCRIPTION OF THE DRAWINGS

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures.

DETAILED DESCRIPTION

Aspects of the present disclosure relate to electrochemical reduction of tobacco-specific nitrosamines (TSNAs). According to certain methods described herein, a tobacco composition containing one or more TSNAs and nicotine is contacted with a solvent to form a tobacco mixture. In some embodiments, the tobacco mixture is introduced into an electrochemical device comprising an anode and a cathode. The tobacco mixture may, in some cases, form at least part of an initial electrolyte mixture that is in physical contact with at least a portion of the anode and at least a portion of the cathode. In some instances, an electrical potential is applied between the anode and the cathode, thereby reducing one or more TSNAs in the initial electrolyte mixture and producing a reduced electrolyte mixture. In certain cases, application of the electrical potential between the anode and the cathode does not cause non-TSNA components of the tobacco mixture (e.g., nicotine) to undergo electrochemical reduction or any other chemical reaction.

Although tobacco plants and harvested tobacco leaves generally do not contain TSNAs, one or more TSNAs are typically formed during the curing and/or processing of tobacco (e.g., through a nitrosation reaction). As a result, TSNAs are often present in tobacco-containing smoking articles (e.g., cigarettes, cigars, cigarillos) and other tobacco-containing products (e.g., chewing tobacco, snuff). In addition, TSNAs are often present in smoke (e.g., mainstream smoke, sidestream smoke) that is produced when a tobacco-containing smoking article is lit and combusted.

At least some TSNAs have been linked to cancer (e.g., oral, lung, esophageal, and pancreatic cancer) in animals and humans. Without wishing to be bound by a particular theory, a TSNA may cause biological damage by interacting with (and therefore disrupting) a heme active site of cytochrome P450, which is involved in metabolizing endogenous and exogenous chemicals. As an illustrative example, a nitrosamine functional group of a TSNA may coordinate with an iron atom in a heme active site of a cytochrome P450 molecule.

Figure 1:
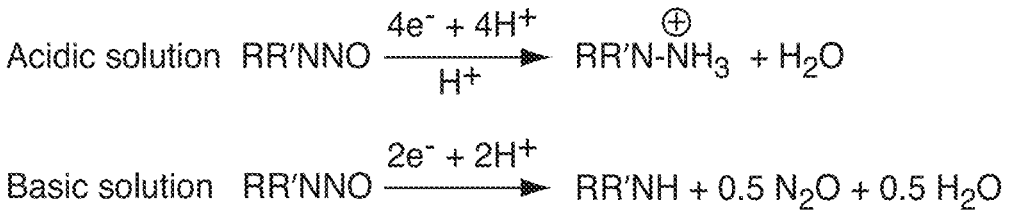
FIG. 1 shows, according to some embodiments, a schematic representation of electrochemical reduction of N-nitrosamines in acidic and basic solutions.

Since TSNAs are carcinogenic, it would be desirable to reduce the level of TSNAs in tobacco products, such as tobacco-containing smoking articles. The inventors have surprisingly found that TSNAs can be reduced through electrochemical reduction (also referred to as electroreduction). Previously, it was known that electrochemical reduction of certain chemical compounds, including uranium, nitrite, nitric oxide, hydrogen peroxide, carbon dioxide, and oxygen, could be catalyzed by metallomacrocyclic compounds (e.g., cobalt porphyrin, iron porphyrin), but it was not known that TSNAs could be reduced by electrochemical reduction. Without wishing to be bound by a particular theory, a protonated TSNA in an acidic solution may be reduced (e.g., to a hydrazine) in a four-electron reaction, as shown in FIG. 1. As FIG. 1 also shows, an unprotonated TSNA in a basic solution may be reduced (e.g., to an amine) in a two-electron reaction.

In some cases, methods of reducing a TSNA through electrochemical reduction are associated with certain advantages. For example, certain methods described herein may selectively reduce one or more TSNAs in a tobacco mixture and may not reduce (or otherwise change the chemical composition of) one or more non-TSNA components of the tobacco mixture (e.g., nicotine). In some cases, certain methods described herein advantageously do not require heating and may be conducted at ambient temperature and/or pressure. In addition, in some cases, certain methods described herein are performed in the absence of toxic metals that would be unsuitable for consumer tobacco products. In certain embodiments, electrochemical reduction of a TSNA is instead catalyzed by an organometallic complex (e.g., a metal porphyrin complex, a metal phthalocyanine complex). In an illustrative, non-limiting example, electrochemical reduction of a TSNA is catalyzed by ferriprotoporphyrin IX chloride (also referred to as "hemin"), which can be extracted from biological materials. Unlike certain metal electrocatalysts, hemin is non-toxic to humans, inexpensive, and readily available.

Certain methods described herein comprise providing a tobacco composition. As used herein, the term "tobacco composition" can comprise any raw or treated (e.g., cured) tobacco-containing material and may include a tobacco extract (including, but not limited to, a fractionated tobacco extract, a filtered tobacco extract, and a distillate or condensate of a tobacco extract), shredded tobacco, tobacco cut filler, expanded tobacco, or homogenized tobacco. The tobacco composition can be a solid, a liquid, an aqueous solution, a non-aqueous solution, a suspension, a slurry, or a gel. In certain embodiments, the tobacco composition is a thermoreversible gel that has a sol-gel transition temperature in the range from room temperature to about 37° C., and from about 37° C. to about 200° C. In some instances, the tobacco composition comprises nicotine. In some instances, the tobacco composition comprises a TSNA.

The term "tobacco" includes a *Nicotiana* species plant or one or more components of a *Nicotiana* species plant, including any component or subcomponent of a leaf, stem, stalk, flower, root, seed, or any other part of a *Nicotiana* species plant. The term "*Nicotiana* species" is used herein to indicate both a single species of *Nicotiana* and two or more species of *Nicotiana* forming a tobacco blend.

In some embodiments, the method comprises contacting the tobacco composition with at least one solvent to form a tobacco mixture. The solvent may be any liquid capable of at least partially dissolving and/or suspending at least a portion of the tobacco composition. In certain embodiments, the solvent is an aqueous solvent. In some instances, for example, the solvent comprises $H_2O$ and/or $D_2O$. In certain embodiments, the solvent is an organic solvent. Non-limiting examples of suitable organic solvents include alcohols (including, but not limited to, methanol, ethanol, and isopropanol), tetrahydrofuran, dioxane, diethyl ether, petroleum ether, chloroform, methylene chloride, toluene, or a combination thereof. In certain instances, the tobacco mixture formed from the tobacco composition and the at least one solvent is a solution. In certain instances, the tobacco mixture is a suspension.

According to certain embodiments, the tobacco mixture comprises a nitrosamine. A nitrosamine generally refers to a chemical compound comprising a nitroso group (i.e., an NO group) bonded to an amine. In some embodiments, the tobacco mixture comprises a tobacco-specific nitrosamine (TSNA). Non-limiting examples of a TSNA include 4-(methylnitrosamino)-1-(3-pyridyl)-1-butanone (NNK), N-nitrosonornicotine (NNN), N'-nitrosoanatabine (NAT), and N-nitrosoanabasine (NAB).

In some embodiments, the tobacco mixture has a concentration of a TSNA of at least about 10 μg/L, at least about 50 μg/L, at least about 100 μg/L, at least about 500 μg/L, at least about 1 mg/L, at least about 5 mg/L, at least about 10 mg/L, at least about 50 mg/L, at least about 0.1 g/L, at least about 0.2 g/L, at least about 0.3 g/L, at least about 0.4 g/L, at least about 0.5 g/L, at least about 0.6 g/L, at least about 0.7 g/L, at least about 0.8 g/L, at least about 0.9 g/L, at least about 1 g/L, at least about 1.1 g/L, at least about 1.2 g/L, at least about 1.3 g/L, at least about 1.4 g/L, at least about 1.5 g/L, at least about 1.6 g/L, at least about 1.7 g/L, at least about 1.8 g/L, at least about 1.9 g/L, or at least about 2.0 g/L. In some embodiments, the tobacco mixture has a concentration of a TSNA in a range from about 10 μg/L to about 100 μg/L, about 10 μg/L to about 500 μg/L, about 10 μg/L to about 1 mg/L, about 10 μg/L to about 5 mg/L, about 10 μg/L to about 10 mg/L, about 10 μg/L to about 50 mg/L, about 10 μg/L to about 0.1 g/L, about 10 μg/L to about 0.5 g/L, about 10 μg/L to about 1.0 g/L, about 10 μg/L to about 1.5 g/L, about 10 μg/L to about 2.0 g/L, about 100 μg/L to about 500 μg/L, about 100 μg/L to about 1 mg/L, about 100 μg/L to about 5 mg/L, about 100 μg/L to about 10 mg/L, about 100 μg/L to about 50 mg/L, about 100 μg/L to about 0.1 g/L, about 100 μg/L to about 0.5 g/L, about 100 μg/L to about 1.0 g/L, about 100 μg/L to about 1.5 g/L, about 100 μg/L to about 2.0 g/L, about 1 mg/L to about 5 mg/L, about 1 mg/L to about 10 mg/L, about 1 mg/L to about 50 mg/L, about 1 mg/L to about 0.1 g/L, about 1 mg/L to about 0.5 g/L, about 1 mg/L to about 1.0 g/L, about 1 mg/L to about 1.5 g/L, about 1 mg/L to about 2.0 g/L, about 0.1 g/L to about 0.5 g/L, about 0.1 g/L to about 1.0 g/L, about 0.1 g/L to about 1.5 g/L, about 0.1 g/L to about 2.0 g/L, about 0.2 g/L to about 1.0 g/L, about 0.2 g/L to about 1.5 g/L, about 0.2 g/L to about 2.0 g/L, about 0.5 g/L to about 1.0 g/L, about 0.5 g/L to about 1.5 g/L, about 0.5 g/L to about 2.0 g/L, about 1.0 g/L to about 2.0 g/L, or about 1.5 g/L to about 2.0 g/L. TSNA concentration may be measured according to any method known in the art. An exemplary method of measuring concentration of a TSNA in a tobacco mixture is liquid chromatography-mass spectrometry (LC-MS).

In some embodiments, the tobacco mixture comprises nicotine. In some cases, the tobacco mixture has a nicotine concentration of at least about 0.01 g/L, at least about 0.02 g/L, at least about 0.05 g/L, at least about 0.1 g/L, at least about 0.2 g/L, at least about 0.3 g/L, at least about 0.4 g/L, at least about 0.5 g/L, at least about 0.6 g/L, at least about 0.7 g/L, at least about 0.8 g/L, at least about 0.9 g/L, at least about 1 g/L, at least about 1.5 g/L, at least about 2 g/L, at least about 3 g/L, at least about 4 g/L, at least about 5 g/L, at least about 6 g/L, at least about 7 g/L, at least about 8 g/L, at least about 9 g/L, at least about 10 g/L, at least about 20 g/L, at least about 50 g/L, or at least about 100 g/L. In certain embodiments, the tobacco mixture has a nicotine concentration in a range from about 0.01 g/L to about 0.1 g/L, about 0.01 g/L to about 0.5 g/L, about 0.01 g/L to about 1 g/L, about 0.01 g/L to about 5 g/L, about 0.01 g/L to about 10 g/L, about 0.01 g/L to about 50 g/L, about 0.01 g/L to about 100 g/L, about 0.05 g/L to about 0.1 g/L, about 0.05 g/L to about 0.5 g/L, about 0.05 g/L to about 1 g/L, about 0.05 g/L to about 5 g/L, about 0.05 g/L to about 10 g/L, about 0.05 g/L to about 50 g/L, about 0.05 g/L to about 100 g/L, about 0.1 g/L to about 1 g/L, about 0.1 g/L to about 5 g/L, about 0.1 g/L to about 10 g/L, about 0.1 g/L to about 50 g/L, about 0.1 g/L to about 100 g/L, about 0.5 g/L to about 1 g/L, about 0.5 g/L to about 5 g/L, about 0.5 g/L to about 10 g/L, about 0.5 g/L to about 50 g/L, about 0.5 g/L to about 100 g/L, about 1 g/L to about 5 g/L, about 1 g/L to about 10 g/L, about 1 g/L to about 50 g/L, about 1 g/L to about 100 g/L, about 5 g/L to about 10 g/L, about 5 g/L to about 50 g/L, about 5 g/L to about 100 g/L, about 10 g/L to about 50 g/L, about 10 g/L to about 100 g/L, or about 50 g/L to about 100 g/L. Nicotine concentration may be measured according to any method known in the art. An exemplary method of measuring nicotine concentration in a tobacco mixture is liquid chromatography-mass spectrometry (LC-MS).

Figure 2A:
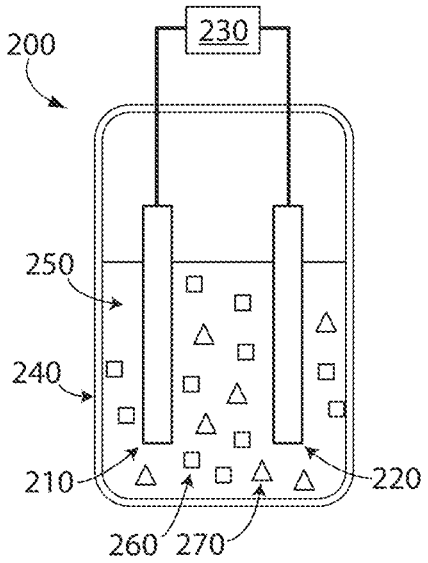
FIG. 2A shows a schematic diagram of an exemplary electrochemical device comprising an anode, a cathode, and an initial electrolyte mixture, according to some embodiments.
Figure 2B:
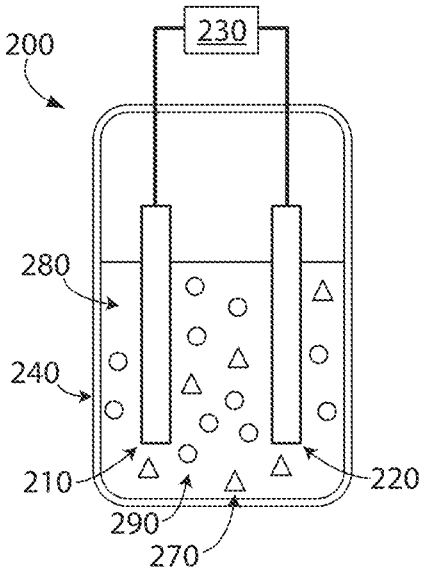
FIG. 2B shows a schematic diagram of an exemplary electrochemical device after application of an electrical potential between the anode and the cathode, according to some embodiments.

In some embodiments, the method comprises contacting an initial electrolyte mixture with an anode and a cathode. In some instances, the anode and the cathode form part of an electrochemical device. As used herein, an electrochemical device refers to a device that is configured to apply an electrical potential across two or more electrodes (e.g., an anode and a cathode) to induce one or more chemical reactions at the electrodes. A schematic diagram of an exemplary electrochemical device is shown in FIGS. 2A-2B. In FIG. 2A, electrochemical device 200 comprises cathode 210 and anode 220. In some embodiments, cathode 210 is electrically connected to direct current source 230 (e.g., to a negative pole of direct current source 230), and anode 220 is electrically connected to direct current source 230 (e.g., to a positive pole of direct current source 230). In addition, electrochemical device 200 further comprises vessel 240, which contains initial electrolyte mixture 250. In some embodiments, the tobacco mixture formed by contacting the tobacco composition with at least one solvent forms at least part of initial electrolyte mixture 250. In certain cases, initial electrolyte mixture 250 comprises molecules 260 of a TSNA. In certain cases, initial electrolyte mixture 250 further comprises molecules 270 of nicotine. Initial electrolyte mixture 250 may also comprise a dissolved salt (not shown in FIG. 1A). The dissolved salt may comprise a cation (e.g., $Li^+$, $Na^+$, $K^+$, $Ca^{2+}$, $Mg^{2+}$) and an anion (e.g., $Cl^-$, $ClO_4^-$, $OH^-$, $CO_3^{2-}$, $HCO^{3-}$). In some embodiments, at least a portion of cathode 210 and at least a portion of anode 220 are immersed in (e.g., in physical contact with) initial electrolyte mixture 250.

In operation, an electrical potential may be applied between the anode and the cathode to form a reduced electrolyte mixture. A schematic diagram of exemplary electrochemical device 200 after an electrical potential has been applied between anode 220 and cathode 210 to produce reduced electrolyte mixture 280 is shown in FIG. 2B. As shown in FIG. 2B, molecules 260 of a TSNA of initial electrolyte mixture 250 have been reduced to molecules 290 of a reduced species (e.g., an amine, a hydrazine). Accordingly, in some embodiments, a concentration of the TSNA in reduced electrolyte mixture 280 is less than a concentration of the TSNA in initial electrolyte mixture 250. However, other components of initial electrolyte mixture 250 may not be reduced. For example, reduced electrolyte mixture 280 may comprise nicotine molecules 270. As shown in FIG. 2B, nicotine molecules 270 of initial electrolyte mixture 250 were not reduced to a reduced species through application of a potential between anode 220 and cathode 210.

In some embodiments, the cathode (e.g., cathode 210 in FIG. 2A) comprises an electrocatalyst. As used herein, the term "cathode" refers to an electrode at which reduction occurs during application of an electrical potential. A "catalyst" generally refers to a substance that initiates and/or facilitates a chemical reaction (e.g., by providing a reaction pathway with a lower activation energy). An "electrocatalyst" generally refers to a catalyst that initiates and/or facilitates electrochemical reactions. In certain cases, for example, an electrocatalyst catalyzes an electrochemical reduction. The term "electrochemical reduction" or "electroreduction" generally refers to conversion of a chemical species to a more reduced chemical species using electrical energy.

The electrocatalyst of the cathode may be any material capable of catalyzing the electrochemical reduction of one or more TSNAs (e.g., to one or more amines and/or one or more hydrazines). In some embodiments, the electrocatalyst comprises an organometallic complex. An organometallic complex generally refers to a molecule comprising at least one metal atom that is bonded (e.g., covalently bonded) to at least one organic group (e.g., a group comprising at least one carbon atom). Non-limiting examples of a suitable metal include iron, cobalt, nickel, copper, zinc, titanium, and chromium. Non-limiting examples of a suitable organic group include a porphyrin group and a phthalocyanine group. In certain embodiments, the organometallic complex comprises a metal porphyrin complex, a metal phthalocyanine complex, or both a metal porphyrin complex and a metal phthalocyanine complex. Examples of suitable metal porphyrin complexes include, but are not limited to, ferriprotoporphyrin IX chloride (also referred to as hemin), iron porphyrin, iron(II)(porphyrinato)(imidazole), a heme protein (e.g., hemoglobin, myoglobin), an iron porphyrin dimer (e.g., an iron tetraphenyl porphyrin dimer), or a combination of two or more of the foregoing. An example of a suitable metal phthalocyanine complex includes, but is not limited to, an iron phthalocyanine complex. In certain instances, the electrocatalyst comprises an iron-containing metalloenzyme. A non-limiting example of an iron-containing metalloenzyme is carbon monoxide dehydrogenase (CODH). In some embodiments, the electrocatalyst of the cathode is substantially free of any noble metal catalyst (e.g., gold, platinum, silver).

Certain electrocatalysts described herein may be associated with certain advantages. In certain embodiments, for example, the electrocatalyst may selectively reduce one or more TSNAs (e.g., to one or more amines and/or one or more hydrazines). In some cases, the electrocatalyst may not reduce one or more non-TSNA components that may be present in the tobacco mixture and/or the initial electrolyte mixture. In certain embodiments, for example, the electrocatalyst may not reduce nicotine. Without wishing to be bound by a particular theory, nicotine, unlike TSNAs comprising a nitroso group, may lack a chemical moiety that can be reduced by the electrocatalysts described herein. For example, nicotine may not comprise a chemical moiety capable of interacting with hemin. In some cases, certain electrocatalysts described herein may be associated with additional advantages. For example, unlike noble metal catalysts, certain electrocatalysts described herein may be readily available at a relatively low cost. In addition, in some cases, certain electrocatalysts described herein are free of toxic metals that are unsuitable for use in consumer tobacco products.

In some embodiments, the electrocatalyst of the cathode is positioned (e.g., immobilized) on a support. In some embodiments, the support is electrically conductive. The support, in certain instances, comprises a carbonaceous material (e.g., a material comprising carbon). In some embodiments, the weight percent of carbon in the carbonaceous material is at least about 50%, at least about 60%, at least about 70%, at least about 90%, at least about 95%, or at least about 99%. Non-limiting examples of a suitable carbonaceous material include carbon nanotubes, graphite, graphene oxide, and carbon foam. In certain embodiments, the carbonaceous material comprises carbon nanotubes. The carbon nanotubes may be single-walled carbon nanotubes (SWNTs) or multi-walled carbon nanotubes (MWNTs). In certain instances, the carbon nanotubes (e.g., SWNTs, MWNTs) are functionalized with one or more functional groups. Examples of suitable functional groups include, but are not limited to, unsubstituted or substituted amino groups, alkyl groups, acyl groups, aryl groups, aralkyl groups, aminoalkyl groups, thiol groups, and hydroxy groups. In some cases, the number of carbon atoms in the alkyl, acyl, aryl, aralkyl, and aminoalkyl groups is in the range from about 1 to 10, about 1 to 20, or about 1 to 30. In certain embodiments, the carbon nanotubes are amino-functionalized carbon nanotubes (e.g., amino-functionalized SWNTs, amino-functionalized MWNTs).

The carbon nanotubes (CNTs) may have any suitable size. In certain embodiments, the carbon nanotubes of the cathode have an average outer diameter of at least about 1 nm, at least about 2 nm, at least about 5 nm, at least about 10 nm, at least about 15 nm, at least about 20 nm, at least about 50 nm, or at least about 100 nm. In some embodiments, the carbon nanotubes have an average outer diameter of about 100 nm or less, about 50 nm or less, about 20 nm or less, about 15 nm or less, about 10 nm or less, about 5 nm or less, about 2 nm or less, or about 1 nm or less. In certain embodiments, the carbon nanotubes have an average outer diameter in a range between about 1 nm and about 5 nm, about 1 nm and about 10 nm, about 1 nm and about 20 nm, about 1 nm and about 50 nm, about 1 nm and about 100 nm, about 5 nm and about 10 nm, about 5 nm and about 20 nm, about 5 nm and about 50 nm, about 5 nm and about 100 nm, about 10 nm and about 20 nm, about 10 nm and about 50 nm, about 10 nm and about 100 nm, about 20 nm and about 50 nm, about 20 nm and about 100 nm, or about 50 nm and about 100 nm. The average outer diameter of the CNTs may be measured according to any method known in the art. An exemplary method of measuring the average outer diameter of the CNTs is scanning electron microscopy (SEM).

In some embodiments, the carbon nanotubes of the cathode have an average length of at least about 100 nm, at least about 200 nm, at least about 500 nm, at least about 1 μm, at least about 2 μm, at least about 5 μm, or at least about 10 μm. In some embodiments, the carbon nanotubes have an average length of about 10 μm or less, about 5 μm or less, about 2 μm or less, about 1 μm or less, about 500 nm or less, about 200 nm or less, or about 100 nm or less. In some embodiments, the carbon nanotubes have an average length in the range of about 100 nm to about 500 nm, about 100 nm to about 1 μm, about 100 nm to about 5 μm, about 100 nm to about 10 μm, about 500 nm to about 1 μm, about 500 nm to about 5 μm, about 500 nm to about 10 μm, about 1 μm to about 5 μm, about 1 μm to about 10 μm, or about 5 μm to about 10 μm. The average length of the CNTs may be measured according to any method known in the art. An exemplary method of measuring the average length of the CNTs is scanning electron microscopy (SEM).

The electrocatalyst may be attached to the support according to any method known in the art. In certain embodiments, the electrocatalyst is attached to the support through one or more covalent bonds. In certain embodiments, the electrocatalyst is attached to the support through one or more non-covalent interactions. Non-limiting examples of suitable non-covalent interactions include physical adsorption, charge interactions, affinity interactions, hydrophobic interactions, hydrogen bonding interactions, van der Waals interactions, dipole-dipole interactions, and combinations thereof.

In some cases, attachment of the electrocatalyst to the support may be mediated by one or more linkers. In some embodiments, a linker comprises two or more functional groups. The linker may be a homofunctional linker (e.g., a linker comprising one type of functional group) or a heterofunctional linker (e.g., a linker comprising two or more types of functional groups). Non-limiting examples of suitable linkers include carbodiimides, maleimides, N-hydroxysuccinimide esters, isothiocyanates, imidoesters, haloacetyls, pyridyl disulfides, and diazirines. In certain instances, one or more linkers facilitate formation of a covalent or non-covalent interaction between at least one atom of the electrocatalyst and at least one atom of the support. As an illustrative example, a carbodiimide linker can facilitate formation of an amide bond between a carboxylic acid group of a hemin electrocatalyst and an amino group of an amino-functionalized CNT. In certain instances, one or more linkers are covalently or non-covalently associated with both the electrocatalyst and the support. In certain embodiments, for example, at least one atom of the electrocatalyst is covalently or non-covalently associated with a linker, and the same linker is covalently or non-covalently associated with at least one atom of the support.

In some embodiments, the electrochemical device comprises an anode (e.g., anode 220 in FIG. 2A). As used herein, the term "anode" refers to an electrode at which oxidation occurs during application of an electrical potential. Non-limiting examples of suitable materials for the anode include silver, copper, aluminum, platinum, titanium, graphite, and carbon nanotubes.

In some embodiments, the electrochemical device further comprises an initial electrolyte mixture. In certain embodiments, the initial electrolyte mixture comprises a dissolved salt (e.g., a salt that has been solubilized to such an extent that the component cation and anion are no longer ionically bonded). In some cases, the dissolved salt comprises a cation such as, for example, $Li^+$, $Na^+$, $K^+$, $Ca^{2+}$, or $Mg^{2+}$. In some cases, the dissolved salt comprises an anion such as, for example, $Cl^-$, $ClO_4^-$, $OH^-$, $CO_3^{2-}$, or $HCO^{3-}$. Non-limiting examples of suitable dissolved salts include NaCl, NaBr, KCl, KBr, $LiClO_4$, $NaCl_4$, $KCl_4$, $Na_2CO_3$, $K_2CO_3$, $Li_2CO_3$, $NaHCO_3$, $KHCO_3$, $LiHCO_3$, $Na_2SO_4$, or a combination thereof.

In some embodiments, the concentration of the dissolved salt in the initial electrolyte mixture is at least about 10 mM, at least about 20 mM, at least about 50 mM, at least about 100 mM, at least about 200 mM, at least about 500 mM, at least about 1000 mM. In some embodiments, the concentration of the dissolved salt in the initial electrolyte mixture is about 1000 mM or less, about 500 mM or less, about 200 mM or less, about 100 mM or less, about 50 mM or less, about 20 mM or less, or about 10 mM or less. In some embodiments, the concentration of the dissolved salt in the initial electrolyte mixture is in the range of about 10 mM to about 50 mM, about 10 mM to about 100 mM, about 10 mM to about 200 mM, about 10 mM to about 500 mM, about 10 mM to about 1000 mM, about 50 mM to about 100 mM, about 50 mM to about 200 mM, about 50 mM to about 500 mM, about 50 mM to about 1000 mM, about 100 mM to about 200 mM, about 100 mM to about 500 mM, about 100 mM to about 1000 mM, about 200 mM to about 500 mM, about 200 mM to about 1000 mM, or about 500 mM to about 1000 mM.

In certain embodiments, the tobacco mixture formed by contacting the tobacco composition and at least one solvent forms at least part of the initial electrolyte mixture. Accordingly, in some cases, the initial electrolyte mixture comprises one or more TSNAs. In some embodiments, the initial electrolyte mixture has a concentration of a TSNA of at least about 10 μg/L, at least about 50 μg/L, at least about 100 μg/L, at least about 500 μg/L, at least about 1 mg/L, at least about 5 mg/L, at least about 10 mg/L, at least about 50 mg/L, at least about 0.1 g/L, at least about 0.2 g/L, at least about 0.3 g/L, at least about 0.4 g/L, at least about 0.5 g/L, at least about 0.6 g/L, at least about 0.7 g/L, at least about 0.8 g/L, at least about 0.9 g/L, at least about 1 g/L, at least about 1.1 g/L, at least about 1.2 g/L, at least about 1.3 g/L, at least about 1.4 g/L, at least about 1.5 g/L, at least about 1.6 g/L, at least about 1.7 g/L, at least about 1.8 g/L, at least about 1.9 g/L, or at least about 2.0 g/L. In some embodiments, the initial electrolyte mixture has a concentration of a TSNA in a range from about 10 μg/L to about 100 μg/L, about 10 μg/L to about 500 μg/L, about 10 μg/L to about 1 mg/L, about 10 μg/L to about 5 mg/L, about 10 μg/L to about 10 mg/L, about 10 μg/L to about 50 mg/L, about 10 μg/L to about 0.1 g/L, about 10 μg/L to about 0.5 g/L, about 10 μg/L to about 1.0 g/L, about 10 μg/L to about 1.5 g/L, about 10 μg/L to about 2.0 g/L, about 100 μg/L to about 500 μg/L, about 100 μg/L to about 1 mg/L, about 100 μg/L to about 5 mg/L, about 100 μg/L to about 10 mg/L, about 100 μg/L to about 50 mg/L, about 100 μg/L to about 0.1 g/L, about 100 μg/L to about 0.5 g/L, about 100 μg/L to about 1.0 g/L, about 100 μg/L to about 1.5 g/L, about 100 μg/L to about 2.0 g/L, about 1 mg/L to about 5 mg/L, about 1 mg/L to about 10 mg/L, about 1 mg/L to about 50 mg/L, about 1 mg/L to about 0.1 g/L, about 1 mg/L to about 0.5 g/L, about 1 mg/L to about 1.0 g/L, about 1 mg/L to about 1.5 g/L, about 1 mg/L to about 2.0 g/L, about 0.1 g/L to about 0.5 g/L, about 0.1 g/L to about 1.0 g/L, about 0.1 g/L to about 1.5 g/L, about 0.1 g/L to about 2.0 g/L, about 0.2 g/L to about 1.0 g/L, about 0.2 g/L to about 1.5 g/L, about 0.2 g/L to about 2.0 g/L, about 0.5 g/L to about 1.0 g/L, about 0.5 g/L to about 1.5 g/L, about 0.5 g/L to about 2.0 g/L, about 1.0 g/L to about 2.0 g/L, or about 1.5 g/L to about 2.0 g/L.

In some embodiments, a peak corresponding to the TSNA appears in an electrospray ionization mass spectrum (ESI-MS) or a matrix-assisted laser desorption/ionization time of flight (MALDI-TOF) spectrum of the initial electrolyte mixture. For example, in certain instances, the ESI-MS and/or MALDI-TOF spectrum of the initial electrolyte mixture contains a peak corresponding to an NNK ion at an m/z of about 208 amu. In some embodiments, the ESI-MS and/or MALDI-TOF spectrum of the initial electrolyte mixture contains a peak corresponding to an NNN ion at an m/z of about 178 amu.

In some embodiments, the initial electrolyte mixture further comprises nicotine. In some cases, the initial electrolyte mixture has a nicotine concentration of at least about 0.01 g/L, at least about 0.02 g/L, at least about 0.05 g/L, at least about 0.1 g/L, at least about 0.2 g/L, at least about 0.3 g/L, at least about 0.4 g/L, at least about 0.5 g/L, at least about 0.6 g/L, at least about 0.7 g/L, at least about 0.8 g/L, at least about 0.9 g/L, at least about 1 g/L, at least about 1.5 g/L, at least about 2 g/L, at least about 3 g/L, at least about 4 g/L, at least about 5 g/L, at least about 6 g/L, at least about 7 g/L, at least about 8 g/L, at least about 9 g/L, at least about 10 g/L, at least about 20 g/L, at least about 50 g/L, or at least about 100 g/L. In certain embodiments, the initial electrolyte mixture has a nicotine concentration in a range from about 0.01 g/L to about 0.1 g/L, about 0.01 g/L to about 0.5 g/L, about 0.01 g/L to about 1 g/L, about 0.01 g/L to about 5 g/L, about 0.01 g/L to about 10 g/L, about 0.01 g/L to about 50 g/L, about 0.01 g/L to about 100 g/L, about 0.05 g/L to about 0.1 g/L, about 0.05 g/L to about 0.5 g/L, about 0.05 g/L to about 1 g/L, about 0.05 g/L to about 5 g/L, about 0.05 g/L to about 10 g/L, about 0.05 g/L to about 50 g/L, about 0.05 g/L to about 100 g/L, about 0.1 g/L to about 1 g/L, about 0.1 g/L to about 5 g/L, about 0.1 g/L to about 10 g/L, about 0.1 g/L to about 50 g/L, about 0.1 g/L to about 100 g/L, about 0.5 g/L to about 1 g/L, about 0.5 g/L to about 5 g/L, about 0.5 g/L to about 10 g/L, about 0.5 g/L to about 50 g/L, about 0.5 g/L to about 100 g/L, about 1 g/L to about 5 g/L, about 1 g/L to about 10 g/L, about 1 g/L to about 50 g/L, about 1 g/L to about 100 g/L, about 5 g/L to about 10 g/L, about 5 g/L to about 50 g/L, about 5 g/L to about 100 g/L, about 10 g/L to about 50 g/L, about 10 g/L to about 100 g/L, or about 50 g/L to about 100 g/L.

In some embodiments, a peak corresponding to nicotine appears in an electrospray ionization mass spectrum (ESI-MS) or a matrix-assisted laser desorption/ionization time of flight (MALDI-TOF) spectrum of the initial electrolyte mixture. In certain embodiments, for example, the ESI-MS and/or MALDI-TOF spectrum of the initial electrolyte mixture contains a peak corresponding to a nicotine cation at an m/z in the range of about 163 amu. In certain embodiments, the ESI-MS and/or MALDI-TOF spectrum of the initial electrolyte mixture contains a peak corresponding to a deuterated nicotine cation at an m/z of about 164 amu.

According to certain embodiments, the initial electrolyte mixture comprises at least one solvent. The solvent may be any liquid capable of at least partially dissolving the dissolved salt. In certain embodiments, the solvent is an aqueous solvent. In some instances, for example, the solvent comprises $H_2O$ and/or $D_2O$. In certain embodiments, the solvent is an organic solvent. Non-limiting examples of suitable organic solvents include alcohols (including, but not limited to, methanol, ethanol, and isopropanol), tetrahydrofuran, dioxane, diethyl ether, petroleum ether, chloroform, methylene chloride, toluene, or a combination thereof. In certain instances, the initial electrolyte mixture is a solution. In certain instances, for example, the initial electrolyte mixture is an aqueous solution comprising water in an amount of at least about 50 wt %, at least about 75 wt %, at least about 90 wt %, or at least about 95 wt %. In certain instances, the initial electrolyte mixture is a suspension.

In some embodiments, the initial electrolyte mixture is acidic. In certain embodiments, the initial electrolyte mixture has a pH of about 7.0 or less, about 6.0 or less, about 5.0 or less, about 4.0 or less, about 3.0 or less, about 2.5 or less, about 2.0 or less, about 1.5 or less, or about 1.0 or less. In certain embodiments, the initial electrolyte mixture has a pH between about 1.0and about 2.0, about 1.0 and about 2.5, about 1.0 and about 3.0, about 1.0 and about 4.0, about 1.0 and about 5.0, about 1.0 and about 6.0, or about 1.0 and about 7.0. In some cases, the pH of the initial electrolyte mixture may be adjusted (e.g., reduced) by adding one or more acids to the initial electrolyte mixture. Examples of suitable acids include, but are not limited to, HCl, DCl, $H_2SO_4$, $H_3PL_4$, $CH_3COOH$, and $HNO_3$.

In some embodiments, the initial electrolyte mixture has a relatively low temperature. In some cases, this may advantageously avoid TSNAs being evaporated into the vapor phase, which could create an environmental hazard. In some embodiments, the initial electrolyte mixture has a temperature of about 60° C. or less, about 50° C. or less, about 40° C. or less, about 30° C. or less, about 25° C. or less, about 20° C. or less, or about 10° C. or less. In some embodiments, the initial electrolyte mixture has a temperature in a range between about 10□ to about 25□, about 10□ to about 30° C., about 10° C. to about 40° C., about 10° C. to about 50° C., about 10° C. to about 60° C., about 20° C. to about 25° C., about 20° C. to about 30° C., about 20° C. to about 40° C., about 20° C. to about 50° C., about 20° C. to about 60° C., about 30° C. to about 40° C., about 30° C. to about 50° C., about 30□ to about 60□, about 40□ to about 50□, about 40□ to about 60□, or about 50□ to about 60° C. In some embodiments, the initial electrolyte mixture is at ambient temperature. In certain cases, the initial electrolyte mixture has a temperature between about 20° C. and about 23° C., about 20° C. and about 25° C., about 21° C. and about 23° C., about 21° C. and about 25° C., about 22° C. and about 23° C., about 22° C. and about 25° C., about 23° C. and about 25° C., or about 24° C. and about 25° C.

Certain embodiments described herein comprise applying an electrical potential between the anode and the cathode of the electrochemical device. In some embodiments, the applied electrical potential is a negative voltage potential. The negative voltage potential may, in some cases, be relatively low. In some instances, a relatively low electrical potential may advantageously reduce energy consumption associated with reducing TSNAs. In some cases, the absolute value of the electrical potential is about 4.0 V or less, about 3.0 V or less, about 2.5 V or less, about 2.0 V or less, about 1.5 V or less, about 1.0 V or less, about 0.5 V or less, about 0.4 V or less, about 0.3 V or less, about 0.2 V or less, or about 0.1 V or less. In some embodiments, the absolute value of the electrical potential is in a range between about 0.0 V to about 0.1 V, about 0.0 V to about 0.2 V, about 0.0 V to about 0.3 V, about 0.0 V to about 0.4 V, about 0.0 V to about 0.5 V, about 0.0 V to about 0.6 V, about 0.0 V to about 0.7 V, about 0.0 V to about 0.8V, about 0.0 V to about 0.9 V, about 0.0 V to about 1 V, about 0.0 V to about 1.5 V, about 0.0 V to about 2.0 V, about 0.0 V to about 2.5 V, about 0.0 V to about 3.0 V, or about 0.0 V to about 4.0 V. In some embodiments, the applied electrical potential is in a range between about 0.0 V and about −0.1 V, about 0.0 V and about −0.2 V, about 0.0 V and about −0.3 V, about 0.0 V and about −0.4 V, about 0.0 V and about −0.5 V, about 0.0 V and about −1.0 V, about 0.0 V and about −1.5 V, about 0.0 V and about −2.0 V, about 0.0 V and about −2.5 V, about 0.0 V and about −3.0V, about 0.0 V and about −4.0 V, about 0.0 V and about −5.0 V, about −0.1 V and about −0.2 V, about −0.1 V and about −0.3 V, about −0.1 V and about −0.4 V, about −0.1 V and about −0.5 V, about −0.1 V and about −1.0 V, about −0.1 V and about −1.5 V, about −0.1 V and about −2.0 V, about −0.1 V and about −2.5 V, about −0.1 V and about −3.0 V, about −0.1 V and about −4.0 V, about −0.1 V and about −5.0 V, about −0.2 V and about −0.5 V, about −0.2 V and about −1.0 V, about −0.2 V and about −1.5 V, about −0.2 V and about −2.0 V, about −0.2 V and about −2.5 V, about −0.2 V and about −3.0 V, about −0.2 V and about −4.0 V, about −0.2 V and about −5.0 V, about −0.5 V and about −1.0 V, about −0.5 V and about −1.5 V, about −0.5 V and about −2.0 V, about −0.5 V and about −2.5 V, about −0.5 V and about −3.0 V, about −0.5 V and about −4.0 V, or about −0.5 V and about −5.0 V.

In some embodiments, the applied electrical potential is applied over a period of time. The period of time may, in some embodiments, be relatively short. In some embodiments, the period of time is about 60 minutes or less, about 30 minutes or less, about 20 minutes or less, about 15 minutes or less, about 10 minutes or less, about 5 minutes or less, or about 1 minute or less. In some embodiments, the period of time is at least about 1 minute, at least about 5minutes, at least about 10 minutes, at least about 15 minutes, at least about 20 minutes, at least about 30 minutes, or at least about 60 minutes. In some embodiments, the period of time is between about 1 minute and about 5 minutes, about 1 minute and about 10 minutes, about 1 minute and about 30 minutes, about 1 minute and about 60 minutes, about 5 minutes and about 10 minutes, about 5 minutes and about 15 minutes, about 5 minutes and about 30 minutes, about 5 minutes and about 60 minutes, about 10 minutes and about 30 minutes, about 10 minutes and about 60 minutes, or about 30 minutes and about 60 minutes.

In some embodiments, applying the electrical potential between the anode and the cathode selectively reduces one or more TSNAs in the initial electrolyte mixture (e.g., to one or more amines, one or more hydrazines) and produces a reduced electrolyte mixture. Accordingly, in some instances, the reduced electrolyte mixture has a lower concentration of a TSNA relative to the initial electrolyte mixture. In some embodiments, the reduced electrolyte mixture has a concentration of a TSNA of about 0.1 g/L or less, about 0.09 g/L or less, about 0.08 g/L or less, about 0.07 g/L or less, about 0.06 g/L or less, about 0.05 g/L or less, about 0.04 g/L or less, about 0.03 g/L or less, about 0.02 g/L or less, about 0.01 g/L or less, about 5 mg/L or less, about 1 mg/L or less, about 500 μg/L or less, about 100 μg/L or less, about 50 μg/L or less, about 10 μg/L or less, about 5 μg/L or less, or about 1 μg/L or less. In some embodiments, the reduced electrolyte mixture has a concentration of a TSNA in a range from about 1 μg/L to about 10 μg/L, about 1 μg/L to about 100 μg/L, about 1 μg/L to about 500 μg/L, about 1 μg/L to about 1 mg/L, about 1 μg/L to about 5 mg/L, about 1 μg/L to about 10 mg/L, about 1 μg/L to about 50mg/L, about 1 μg/L to about 0.1 g/L, about 10 μg/L to about 100 μg/L, about 10 μg/L to about 500 μg/L, about 10 μg/L to about 1 mg/L, about 10 μg/L to about 5 mg/L, about 10 μg/L to about 10 mg/L, about 10 μg/L to about 50 mg/L, about 10 μg/L to about 0.1 g/L, about 100 μg/L to about 500 μg/L, about 100 μg/L to about 1 mg/L, about 100 μg/L to about 5 mg/L, about 100 μg/L to about 10 mg/L, about 100 μg/L to about 50 mg/L, about 100 μg/L to about 0.1 g/L, about 1 mg/L to about 5 mg/L, about 1 mg/L to about 10 mg/L, about 1 mg/L to about 50 mg/L, about 1 mg/L to about 0.1 g/L, about 10 mg/L to about 50 mg/L, about 10 mg/L to about 0.1 g/L, or about 50 mg/L to about 0.1 g/L.

In some cases, a difference between the concentration of a TSNA in the initial electrolyte mixture and the concentration of the TSNA in the reduced electrolyte mixture is relatively large. In certain embodiments, the difference is at least about 0.001 g/L, at least about 0.005 g/L, at least about 0.01 g/L, at least about 0.05 g/L, at least about 0.1 g/L, at least about 0.5 g/L, at least about 1.0 g/L, at least about 1.5 g/L, or at least about 1.9 g/L. In some embodiments, the difference is in the range from about 0.001 g/L to about 0.005 g/L, about 0.001 g/L to about 0.01g/L, about 0.001 g/L to about 0.05 g/L, about 0.01 g/L to about 0.1 g/L, about 0.01 g/L to about 0.5 g/L, about 0.01 g/L to about 1.0 g/L, about 0.01 g/L to about 1.5 g/L, about 0.01 g/L to about 1.9 g/L, about 0.01 g/L to about 0.05 g/L, about 0.01 g/L to about 0.1 g/L, about 0.01 g/L to about 0.5 g/L, about 0.01 g/L to about 1.0 g/L, about 0.01 g/L to about 1.5 g/L, about 0.01 g/L to about 1.9 g/L, about 0.1 g/L to about 0.5 g/L, about 0.1 g/L to about 1.0 g/L, about 0.1 g/L to about 1.5 g/L, about 0.1 g/L to about 1.9 g/L, about 0.5 g/L to about 1.0 g/L, about 0.5 g/L to about 1.5 g/L, about 0.5 g/L to about 1.9 g/L, about 1.0 g/L to about 1.5 g/L, about 1.0 g/L to about 1.9 g/L, or about 1.5 g/L to about 1.9 g/L.

In some embodiments, a peak corresponding to the TSNA does not appear in an electrospray ionization mass spectrum (ESI-MS) or a matrix-assisted laser desorption/ionization time of flight (MALDI-TOF) spectrum of the reduced electrolyte mixture. For example, in certain embodiments, the ESI-MS and/or MALDI-TOF spectrum of the reduced electrolyte mixture do not have a peak corresponding to an NNK ion at an m/z of about 208 amu. In some embodiments, the ESI-MS and/or MALDI-TOF spectrum of the reduced electrolyte mixture do not have a peak corresponding to an NNN ion at an m/z of about 178 amu.

In some embodiments, one or more peaks corresponding to a reduced species of the TSNA appears in an electrospray ionization mass spectrum (ESI-MS) or a matrix-assisted laser desorption/ionization time of flight (MALDI-TOF) spectrum of the reduced electrolyte mixture. In certain embodiments, for example, the ESI-MS and/or MALDI-TOF spectrum of the reduced electrolyte mixture contain one or more peaks corresponding to a hydrazine cation and/or a deuterated hydrazine cation at an m/z in the range of about 195 amu to about 197 amu. In some embodiments, the ESI-MS and/or MALDI-TOF spectrum contain a peak corresponding to 2-(pyridin-3-yl)pyrrolidin-1-aminium at an m/z of about 164 amu.

In some embodiments, applying the electrical potential between the anode and the cathode does not reduce (or otherwise change the chemical composition of) any nicotine present in the initial electrolyte mixture. Accordingly, in some cases, the reduced electrolyte mixture has a relatively high nicotine concentration. In some cases, the reduced electrolyte mixture has a nicotine concentration of at least about 0.01 g/L, at least about 0.02 g/L, at least about 0.05 g/L, at least about 0.1 g/L, at least about 0.2 g/L, at least about 0.3 g/L, at least about 0.4 g/L, at least about 0.5 g/L, at least about 0.6 g/L, at least about 0.7 g/L, at least about 0.8 g/L, at least about 0.9 g/L, at least about 1 g/L, at least about 1.5 g/L, at least about 2 g/L, at least about 3 g/L, at least about 4 g/L, at least about 5 g/L, at least about 6 g/L, at least about 7 g/L, at least about 8g/L, at least about 9 g/L, at least about 10 g/L, at least about 20 g/L, at least about 50 g/L, or at least about 100 g/L. In certain embodiments, the reduced electrolyte mixture has a nicotine concentration in a range from about 0.01 g/L to about 0.1 g/L, about 0.01 g/L to about 0.5 g/L, about 0.01 g/L to about 1 g/L, about 0.01 g/L to about 5 g/L, about 0.01 g/L to about 10 g/L, about 0.01 g/L to about 50 g/L, about 0.01 g/L to about 100 g/L, about 0.05 g/L to about 0.1 g/L, about 0.05 g/L to about 0.5 g/L, about 0.05 g/L to about 1 g/L, about 0.05 g/L to about 5 g/L, about 0.05 g/L to about 10 g/L, about 0.05 g/L to about 50 g/L, about 0.05 g/L to about 100 g/L, about 0.1 g/L to about 1 g/L, about 0.1 g/L to about 5 g/L, about 0.1 g/L to about 10 g/L, about 0.1 g/L to about 50 g/L, about 0.1 g/L to about 100 g/L, about 0.5 g/L to about 1 g/L, about 0.5g/L to about 5 g/L, about 0.5 g/L to about 10 g/L, about 0.5 g/L to about 50 g/L, about 0.5 g/L to about 100 g/L, about 1 g/L to about 5 g/L, about 1 g/L to about 10 g/L, about 1 g/L to about 50g/L, about 1 g/L to about 100 g/L, about 5 g/L to about 10 g/L, about 5 g/L to about 50 g/L, about 5 g/L to about 100 g/L, about 10 g/L to about 50 g/L, about 10 g/L to about 100 g/L, or about 50 g/L to about 100 g/L.

In some embodiments, a peak corresponding to nicotine appears in an electrospray ionization mass spectrum (ESI-MS) or a matrix-assisted laser desorption/ionization time of flight (MALDI-TOF) spectrum of the reduced electrolyte mixture. In certain embodiments, for example, the ESI-MS and/or MALDI-TOF spectrum of the reduced electrolyte mixture contains a peak corresponding to a nicotine cation at an m/z in the range of about 163 amu. In certain embodiments, the ESI-MS and/or MALDI-TOF spectrum of the reduced electrolyte mixture contains a peak corresponding to a deuterated nicotine cation at an m/z of about 164 amu.

In some embodiments, applying the electrical potential between the anode and the cathode is performed at a relatively low temperature. In some cases, this may advantageously avoid TSNAs being evaporated into the vapor phase, which could create an environmental hazard. In some embodiments, the electrical potential is applied at a temperature of about 60° C. or less, about 50° C. or less, about 40° C. or less, about 30° C. or less, about 25° C. or less, about 20° C. or less, or about 10° C. or less. In some embodiments, the electrical potential is applied at a temperature in a range between about 10° C. to about 25° C., about 10° C. to about 30° C., about 10° C. to about 40° C., about 10° C. to about 50° C., about 10° C. to about 60° C., about 20° C. to about 25° C., about 20° C. to about 30° C., about 20° C. to about 40° C., about 20° C. to about 50° C., about 20° C. to about 60° C., about 30° C. to about 40° C., about 30° C. to about 50° C., about 30° C. to about 60° C., about 40° C. to about 50° C., about 40° C. to about 60° C., or about 50° C. to about 60° C. In some embodiments, the electrical potential is applied at ambient temperature. In certain cases, the electrical potential is applied at a temperature between about 20° C. and about 23° C., about 20° C. and about 25° C., about 21° C. and about 23° C., about 21° C. and about 25° C., about 22° C. and about 23° C., about 22° C. and about 25° C., about 23° C. and about 25° C., or about 24° C. and about 25° C.

In some embodiments, the reduced electrolyte mixture has a relatively low temperature. In some embodiments, the reduced electrolyte mixture has a temperature of about 60° C. or less, about 50° C. or less, about 40° C. or less, about 30° C. or less, about 25° C. or less, about 20° C. or less, or about 10° C. or less. In some embodiments, the reduced electrolyte mixture has a temperature in a range between about 10° C. to about 25° C., about 10° C. to about 30° C., about 10° C. to about 40° C., about 10° C. to about 50° C., about 10° C. to about 60° C., about 20° C. to about 25° C., about 20° C. to about 30° C., about 20° C. to about 40° C., about 20° C. to about 50° C., about 20° C. to about 60° C., about 30° C. to about 40° C., about 30° C. to about 50° C., about 30° C. to about 60° C., about 40° C. to about 50° C., about 40° C. to about 60° C., or about 50° C. to about 60° C. In some embodiments, the reduced electrolyte mixture is at ambient temperature. In certain cases, the reduced electrolyte mixture has a temperature between about 20° C. and about 23° C., about 20° C. and about 25° C., about 21□ and about 23□, about 21□ and about 25□, about 22□ and about 23□, about 22□ and about 25° C., about 23° C. and about 25° C., or about 24° C. and about 25° C.

In some embodiments, the reduced electrolyte mixture is acidic. In certain embodiments, the reduced electrolyte mixture has a pH of about 7.0 or less, about 6.0 or less, about 5.0 or less, about 4.0 or less, about 3.0 or less, about 2.5 or less, about 2.0 or less, about 1.5 or less, or about 1.0 or less. In certain embodiments, the reduced electrolyte mixture has a pH between about 1.0 and about 2.0, about 1.0 and about 2.5, about 1.0 and about 3.0, about 1.0 and about 4.0, about 1.0 and about 5.0, about 1.0 and about 6.0, or about 1.0 and about 7.0.

In some embodiments, the reduced electrolyte mixture advantageously does not comprise any components that would be toxic to humans (e.g., toxic metals). Accordingly, in some embodiments, the reduced electrolyte mixture may be incorporated into a consumer tobacco product.

In certain embodiments, the method further comprises forming a tobacco substrate from the reduced electrolyte mixture. The tobacco substrate can be a solid, a liquid, an aqueous solution, a non-aqueous solution, a suspension, a slurry, or a gel. In certain embodiments, the tobacco substrate is a thermoreversible gel that has a sol-gel transition temperature in the range from room temperature to about 37° C., and from about 37° C. to about 200° C. In some embodiments, the tobacco substrate forms at least part of an aerosol-generating substrate. The aerosol-generating substrate can be a solid, a liquid, an aqueous solution, a non-aqueous solution, a suspension, a slurry, or a gel. As an illustrative, non-limiting example, an aerosol-generating substrate may comprise an e-liquid containing tobacco extract.

In certain embodiments, the method further comprises forming a smoking article from the tobacco substrate. A "smoking article" in accordance with the present disclosure may comprise an "aerosol-generating article" in which a nicotine-containing aerosol can be generated from an aerosol-generating substrate. In certain embodiments, the aerosol-generating substrate comprises a tobacco substrate. In some embodiments, a nicotine-containing aerosol is generated through combustion of the aerosol-generating substrate. In certain embodiments, for example, the smoking article is a cigarette, cigar, cigarillo, or other article in which an aerosol-generating substrate is lit and combusted to produce a nicotine-containing aerosol (e.g., smoke). In some embodiments, a nicotine-containing aerosol is generated by heat without combusting the aerosol-generating substrate. In certain cases, the aerosol-generating substrate may be heated by one or more electrical heating elements to produce the aerosol. In some embodiments, the nicotine-containing aerosol is generated without heating, for example through a chemical reaction. In certain instances, the nicotine-containing aerosol is produced by the transfer of heat from a combustible or chemical heat source to a physically separate aerosol-generating substrate, which may be located within, around, or downstream of the heat source.

Certain aspects relate to use of the reduced electrolyte mixture formed by methods described herein to form a tobacco substrate. The tobacco substrate can be a solid, a liquid, an aqueous solution, a non-aqueous solution, a suspension, a slurry, or a gel. In certain embodiments, the tobacco substrate is a thermoreversible gel that has a sol-gel transition temperature in the range from room temperature to about 37° C., and from about 37° C. to about 200° C. In some embodiments, the tobacco substrate forms at least part of an aerosol-generating substrate. The aerosol-generating substrate can be a solid, a liquid, an aqueous solution, a non-aqueous solution, a suspension, a slurry, or a gel. As an illustrative, non-limiting example, an aerosol-generating substrate may comprise an e-liquid containing tobacco extract.

Certain aspects relate to use of the tobacco substrate to form a smoking article. In some embodiments, the smoking article comprises an aerosol-generating article in which a nicotine-containing aerosol can be generated from an aerosol-generating substrate. In certain embodiments, the aerosol-generating substrate comprises a tobacco substrate. In some embodiments, a nicotine-containing aerosol is generated through combustion of the aerosol-generating substrate. In certain embodiments, for example, the smoking article is a cigarette, cigar, cigarillo, or other article in which an aerosol-generating substrate is lit and combusted to produce a nicotine-containing aerosol (e.g., smoke). In some embodiments, a nicotine-containing aerosol is generated by heat without combusting the aerosol-generating substrate. In certain cases, the aerosol-generating substrate may be heated by one or more electrical heating elements to produce the aerosol. In some embodiments, the nicotine-containing aerosol is generated without heating, for example through a chemical reaction. In certain instances, the nicotine-containing aerosol is produced by the transfer of heat from a combustible or chemical heat source to a physically separate aerosol-generating substrate, which may be located within, around, or downstream of the heat source.

Certain aspects relate to a tobacco substrate comprising the reduced electrolyte mixture formed by methods for reducing a tobacco-specific nitrosamine described herein. In some embodiments, the method comprises contacting an initial electrolyte mixture with an anode and a cathode, wherein the initial electrolyte mixture comprises nicotine, the tobacco-specific nitrosamine, a dissolved salt, and at least one solvent. In some embodiments, the method further comprises applying an electrical potential between the anode and the cathode to form a reduced electrolyte mixture, wherein a concentration of the tobacco-specific nitrosamine in the reduced electrolyte mixture is lower than a concentration of the tobacco-specific nitrosamine in the initial electrolyte mixture.

In some embodiments, the tobacco substrate is a solid, a liquid, an aqueous solution, a non-aqueous solution, a suspension, a slurry, or a gel. The tobacco substrate may, in some instances, form at least part of an aerosol-generating substrate. In some embodiments, the aerosol-generating substrate is a solid, a liquid, an aqueous solution, a non-aqueous solution, a suspension, a slurry, or a gel. As an illustrative, non-limiting example, an aerosol-generating substrate may comprise an e-liquid containing tobacco extract.

Certain aspects relate to a smoking article comprising a tobacco substrate, said tobacco substrate comprising the reduced electrolyte mixture formed by methods for reducing a tobacco-specific nitrosamine described herein. In some embodiments, the method comprises contacting an initial electrolyte mixture with an anode and a cathode, wherein the initial electrolyte mixture comprises nicotine, the tobacco-specific nitrosamine, a dissolved salt, and at least one solvent. In some embodiments, the method further comprises applying an electrical potential between the anode and the cathode to form a reduced electrolyte mixture, wherein a concentration of the tobacco-specific nitrosamine in the reduced electrolyte mixture is lower than a concentration of the tobacco-specific nitrosamine in the initial electrolyte mixture.

In some embodiments, the smoking article comprises an aerosol-generating article in which a nicotine-containing aerosol can be generated from an aerosol-generating substrate. In certain embodiments, the tobacco substrate forms at least part of the aerosol-generating substrate. In some embodiments, a nicotine-containing aerosol is generated through combustion of the aerosol-generating substrate. In certain embodiments, for example, the smoking article is a cigarette, cigar, cigarillo, or other article in which an aerosol-generating substrate is lit and combusted to produce a nicotine-containing aerosol (e.g., smoke). In some embodiments, a nicotine-containing aerosol is generated by heat without combusting the aerosol-generating substrate. In certain cases, the aerosol-generating substrate may be heated by one or more electrical heating elements to produce the aerosol. In some embodiments, the nicotine-containing aerosol is generated without heating, for example through a chemical reaction. In certain instances, the nicotine-containing aerosol is produced by the transfer of heat from a combustible or chemical heat source to a physically separate aerosol-generating substrate, which may be located within, around, or downstream of the heat source.

EXAMPLE 1

This example relates to preparation of a catalytic electrode material and related electrochemical measurements.

Materials. Ferriprotoporphyrin IX chloride (hemin from bovine, greater than or equal to 90%), carbon nanotubes (multi-walled, outer diameter (O.D.)×length (L)=6-9 nm×5 μm, greater than 95% carbon), N-(3-dimethylaminopropyl)-N'-ethylcarbodiimide hydrochloride (crystalline, 99%, EDAC), (±)-nicotine (greater than or equal to 99% by TLC), N'-nitrosonornicotine (analytical standard, NNN), 4-(methylnitrosoamino )-1-(3-pyridinyl)-1-butanone (analytical standard, NNK) were all obtained from Sigma-Aldrich. Amino-functionalized multi-walled carbon nanotubes (outer diameter, less than 20 nm; inside diameter, 4 nm; ash, 0 wt %; purity: greater than 99 wt %; CNT-NH2) were obtained from Cheap Tubes, Inc. (Cambridgeport, Vt.). Toray Paper (carbon fiber composite carbon paper) was obtained from Electrochem Inc. (Woburn, Mass.).

Synthesis of hemin-CNT conjugate. 100 mg of hemin was dissolved in 30 mL of 20 mM aqueous NaOH to result in solution A. 400 mg of ED AC was dissolved in phosphate-buffered saline diluted 10-fold by deionized water (pH 7.4, 20 mL) to result in solution B. 100 mg of nanotubes CNT-NH2 were suspended in phosphate-buffered saline diluted 10-fold by deionized water (pH 7.4), and the suspension was sonicated in an ice-cold bath for 15 min. The suspension was then mixed with solution B and subsequently mixed with solution A. The resulting black suspension was shaken for 8 hours at room temperature and dialyzed against excess deionized water (membrane MWCO, 12-14 kDa). The suspension was then centrifuged at 9,000 rpm for 5 minutes, and particles were separated from the supernatant, resuspended in deionized water with sonication, and again separated by centrifugation. The process of washing was repeated 3 times. The resulting wet CNT-hemin material was snap-frozen in liquid nitrogen and lyophilized to dryness.

Working Electrode Preparation. The working electrodes were prepared from 2×1 cm swatches of Toray paper connected with conductive copper tape and wire by soldering. The copper wire connected the electrode to the potentiostat USB cable by 2 mm banana connectors and mini-crocodile clips. The hemin-CNT electrodes were prepared by drop casting. A stock suspension of 80 mg hemin-CNT (Sigma-Aldrich) in 10 mL anhydrous chloroform was sonicated for 15 minutes in icy water to optimize the dispersion. 50 μL of the resulting suspension were then drop-cast on the Toray paper part of the working electrode and left to dry at 25° C. on air until a constant weight was reached.

Measurements. Cyclic voltammetry (CV) and chronoamperometric measurements were performed with a VersaSTAT 3 potentiostat (Princeton Applied Research, Oak Ridge, Tenn.) using a three-electrode electrolyzer (microcell assembly MF 1065, Bioanalytical Systems, Inc., West Lafayette, IN) consisting of a working electrode (above), a reference Ag/AgCl reference electrode filled with an aqueous 3 M NaCl solution, and a platinum wire auxiliary electrode. A 0.15 M solution of $LiClO_4$ in deuterated hydrochloric acid (DCl) in deuterium oxide ($D_2O$, pD about 1) was used as an electrolyte. The electrolyte was purged with nitrogen flow prior to the measurements, which were all conducted at 25° C. The electrolyte contained measured concentrations of nicotine, NNK and NNN for testing.

Figure 3:
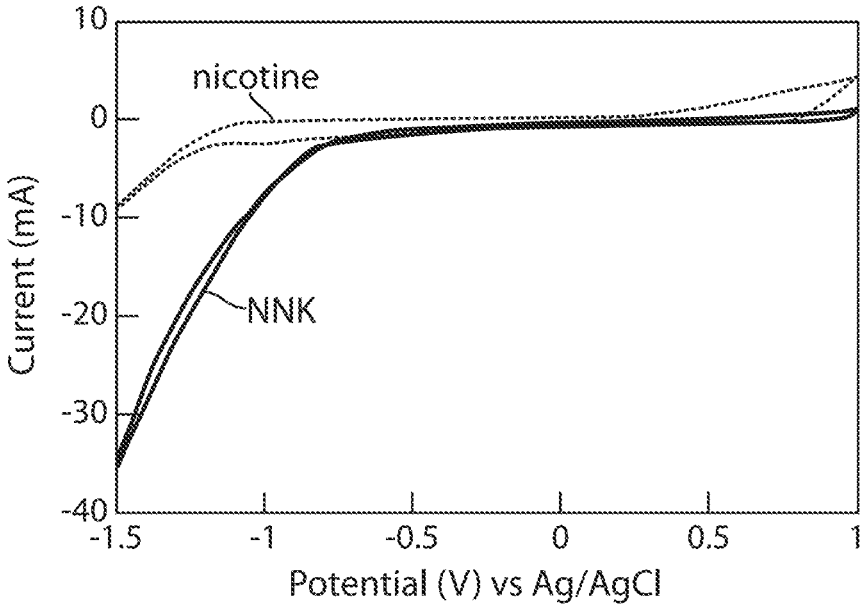
FIG. 3 shows, according to some embodiments, exemplary cyclic voltammetry results of nicotine and NNK at a 10 mV scan rate, pH 1.0, and 25° C.

Exemplary cyclic voltammetry results are shown in FIG. 3. In particular, FIG. 3 shows voltammetry results of nicotine and NNK at a 10 mV scan rate, pH 1.0, and 25° C. The electrolyte was 0.15 M $LiClO_4$ in aqueous ($D_2O$/DCl) solutions of NNK (initial concentration, 0.4 g/L or 1.9 mM) or nicotine (initial concentration, 1 g/L or 6.2 mM). The working electrode was hemin-CNT on Toray carbon paper, the reference electrode was Ag/AgCl, and the auxiliary electrode was Pt wire.

As shown in FIG. 3, NNK generated significantly higher currents at negative potentials than nicotine despite the 3.2-fold lower initial concentration. Without being bound by any theory, this may be explained by the catalyzed electroreduction of NNK at an acidic pH of 1. In contrast to NNK, nicotine lacks chemical moieties that can be reduced and, hence, does not generate much current. In order to complete the reduction, each NNK solution in the electrolyte and electrochemical setup described above was exposed to constant −1.5 V potential for 10 minutes (chronoamperometric experiment). In the control experiments, nicotine solutions underwent identical treatment.

Figure 4:
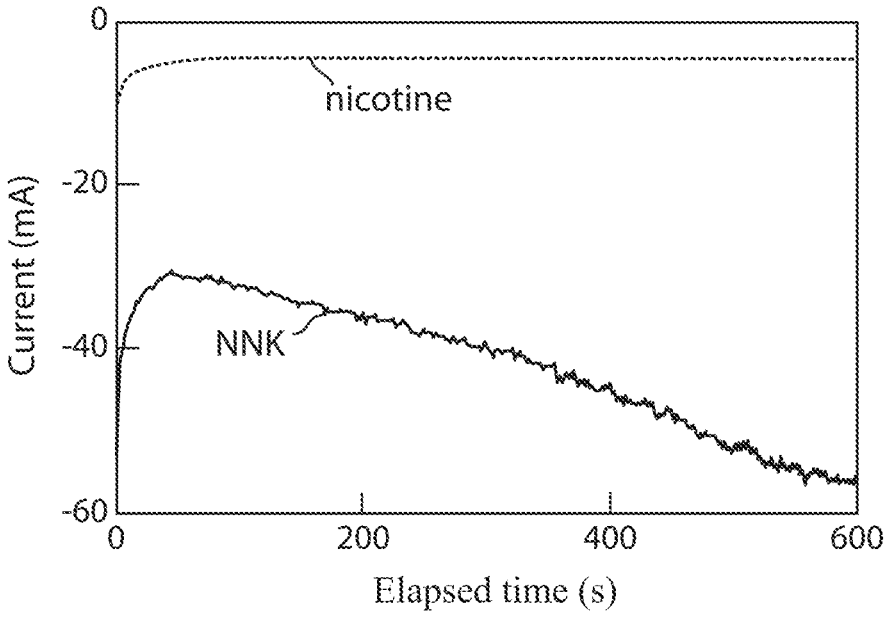
FIG. 4 shows exemplary chronoamperometry results of NNK and nicotine at −1.5 V reducing potential, pH 1.0, and 25° C., according to some embodiments.

The results of chronoamperometric measurements are shown in FIG. 4. NNK was reduced in acidic aqueous solution by electrons generated at the hemin-CNT electrode surface that was kept at a constant negative potential of −1.5 V. In particular, FIG. 4 shows chronoamperometry results of NNK and nicotine at −1.5 V reducing potential, pH 1.0, and 25° C. The electrolyte was 0.15 M LiClC>4 in aqueous ($D_2O$/DC1) solutions of NNK (initial concentration, 0.4 g/L or 1.9 mM) or nicotine (initial concentration, 1 g/L or 6.2 mM). The working electrode was hemin-CNT on Toray carbon paper, the reference electrode was Ag/AgCl, and the auxiliary electrode was platinum wire.

As is shown in FIG. 4, the current decayed in time, indicating that the reduction reaction was limited by diffusion of the NNK species to the electrode surface. In contrast, in the case of a nicotine solution held under identical conditions at a potential of −1.5 V, no significant current decay was observed, indicating that the only apparent electrochemical reaction occurring at the cathode was the reduction of water ( $2\ H^+(aq)+2e^- \rightarrow H_2\ (g)$) that resulted in the appearance of hydrogen bubbles.

EXAMPLE 2

In this Example, the NNK solution that underwent the exposure to constant potential of −1.5 V for 10 min as described in Example 1 was subjected to mass spectroscopic analysis. The mass spectra were obtained using a Bruker Apex IV FT-ICR mass spectrometer (Bruker Daltonics Inc., Billerica, Mass.) equipped with a 160 mm bore 4.7 Tesla actively shielded magnet and an Apollo I electrospray ionization source. Samples were directly injected into the mass spectrometer using a Cole Palmer series 74900 syringe pump at a flow rate of 5 mL/min. Ions were generated in positive and negative ion mode at a nebulizer $N_2$ gas pressure of 40 psi and a dry gas temperature of 200° C. at 30 psi. The calibration standard was Agilent ESI Tuning mix. The error range for daily calibration is within ±5 ppm from 152 m/z to 1521 m/z.

The ESI source voltages are shown in Table 1.

TABLE 1

| | Positive (V) | Negative (V) |
|---|---|---|
| Capillary | −3724 | 3207 |
| Endplate | −3355 | 2839 |
| CapExit | 112.4 | −22.1 |
| Skimmer 1 | 33.18 | −17.74 |
| Skimmer 2 | 10.14 | −10.25 |
| Offset | 2.76 | −0.92 |

TABLE 1-continued

| | Positive (V) | Negative (V) |
|---|---|---|
| Trap | 14.75 | −8.06 |
| Extract | −35.71 | 17.05 |

Figure 5:
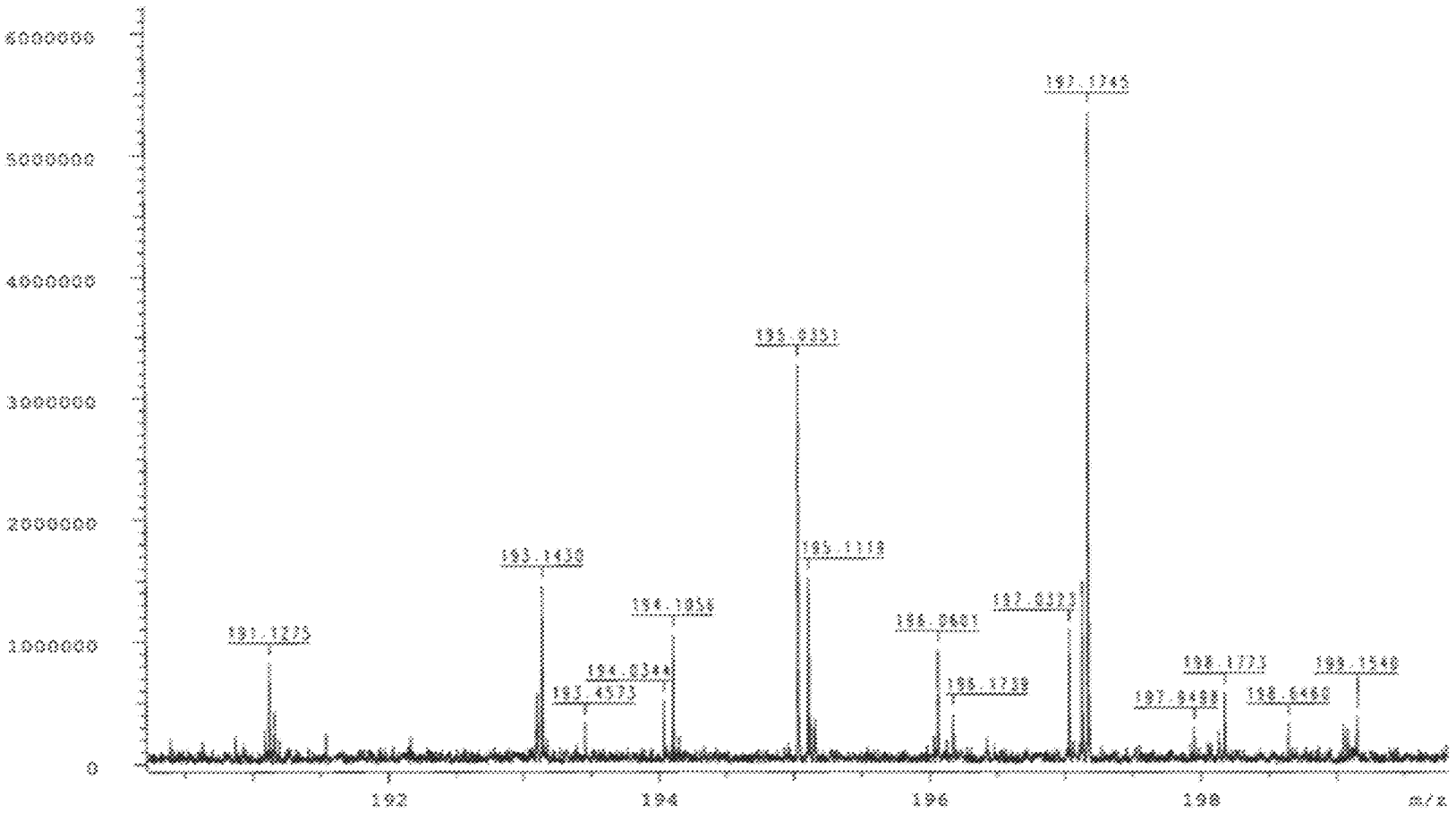
FIG. 5 shows, according to some embodiments, an exemplary electrospray ionization mass spectrum of NNK.
Figure 6:
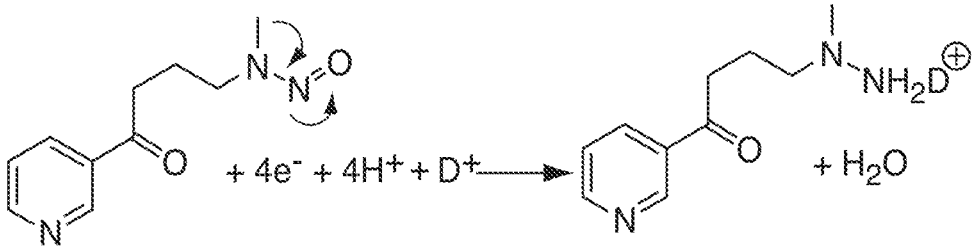
FIG. 6 shows a schematic representation of electroreduction of NNK to a hydrazine, according to some embodiments.

FIG. 5 shows an electrospray ionization mass spectrum (ESI-MS) of NNK solution that underwent electroreduction at −1.5 V for 10 min at a pH of about 1. No presence of the precursor NNK ion [$NNK^+H$] at m/z (amu) 208.1 or its product ions at m/z of 178.1 and 122.0 was detectable, with a detection limit below 1 ng/g. However, the presence of hydrazine NNK—$NH(CH_3)$—$NH_3^+$ cation and its deuterated species in the m/z 195 amu area was positively identified (FIG. 5). Hence, the electroreduction of NNK was confirmed. Without being bound by any theory, the electrochemical formation of deuterium exchanged 4-(1-methylhydrazinyl)-1-(pyridin-3-yl)butan-1-one cation (Calc., m/z: 195.14 (100.0%), 196.14 (11.0%), 196.13 (1.1%)) from NNK is depicted in FIG. 6. FIG. 6 shows an exemplary schematic representation of electroreduction of NNK to hydrazine in an acidic aqueous medium in the presence of DCl.

Figure 7:
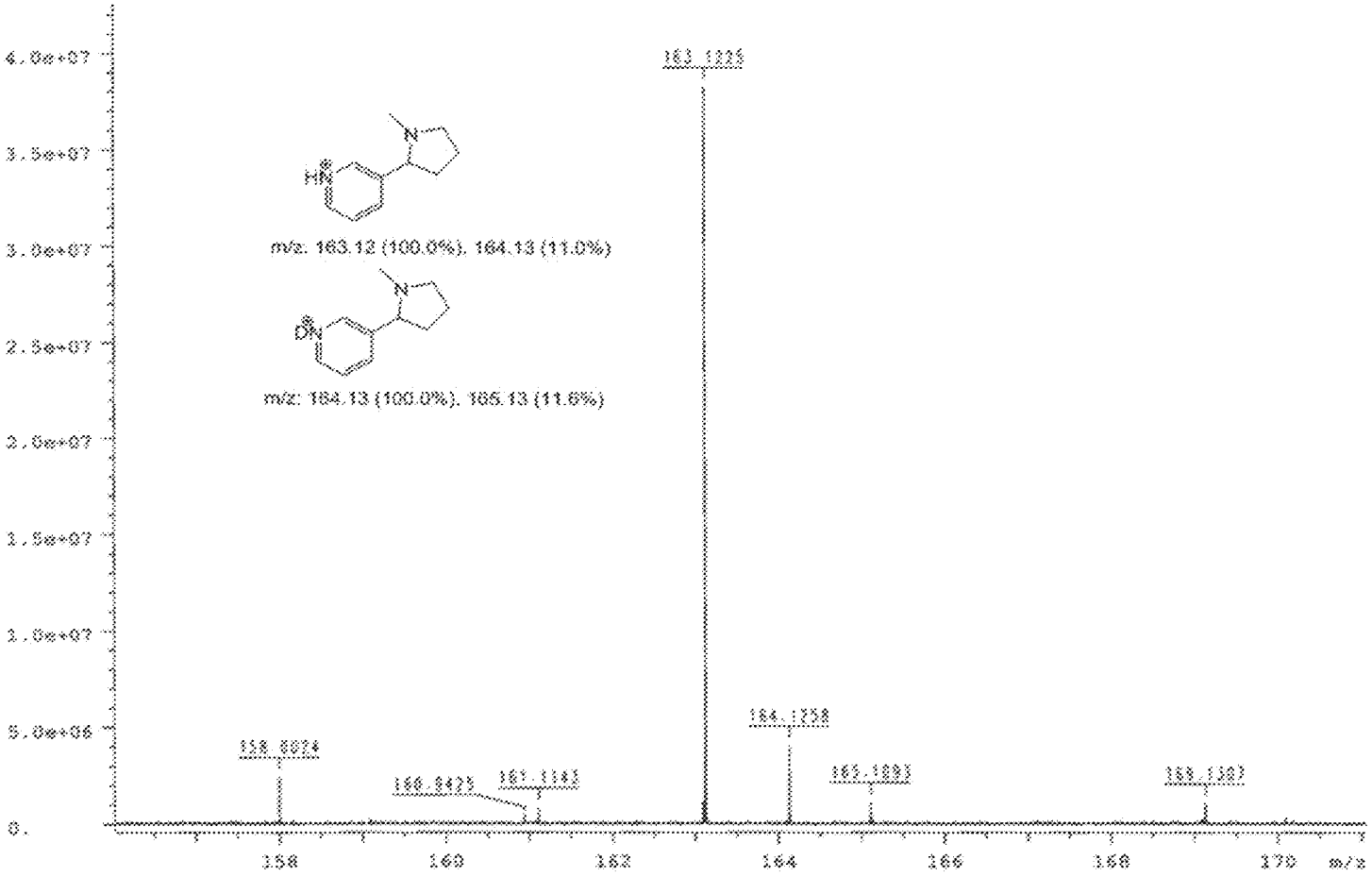
FIG. 7 shows, according to some embodiments, an exemplary electrospray ionization mass spectrum of nicotine.

The results of the control experiment, in which nicotine underwent the electrochemical treatment identical to the one for NNK described above, are presented in FIG. 7. In particular, FIG. 7 shows an electrospray ionization mass spectrum of nicotine that underwent chronoamperometry at a reducing potential of −1.5 V at the hemin-CNT cathode for 10 minutes at pH of about 1. The structures and calculated m/z values of the corresponding cationic species are also shown. From FIG. 7, it can be seen that the mass spectrum corresponded very well to the [nicotine H] cations that were unchanged by the electrochemical treatment. No other nicotine species were identified.

EXAMPLE 3

In this Example, selectivity of NNK reduction in its mixtures with nicotine was confirmed. A mixture of nicotine and NNK aqueous solutions containing 0.15 M $LiClO_4$ was prepared, so that the resulting nicotine and NNK concentrations were 1 g/L (6.2 mM) and 0-4 g/L (1.9 mM), respectively. The pH was adjusted to about 1.0 by deuterated hydrochloric acid (DCl). The mixture (5 mL total) was loaded into a 3-electrode electrolyzer as in Example 1. The mixture was deaerated by nitrogen flow, and a chronoamperometric experiment was conducted, wherein the reducing potential of −1.5 V was applied as in Example 1.

Small aliquots of the original mixture and the mixture that underwent the electrochemical reduction were subjected to analysis using matrix-assisted laser desorption/ionization time of flight (MALDI-TOF) spectrometry with a microflex™ LT benchtop linear MALDI-TOF Mass Spectrometer (Bruker Daltonics, Bremen, Germany) equipped with a microScout Ion Source with pulsed ion extraction and a nitrogen laser with variable repetition rate. Spectra were recorded in the positive linear mode (delay: 170 ns; ion source 1 (IS1) voltage: 20 kV; ion source 2 (IS2) voltage: 16.65 kV; lens voltage: 7.20 kV; mass range: 100 Da to 1 kDa). Each spectrum was obtained after 240 shots in automatic mode at a variable laser power, and the acquisition time was 120 seconds per spot. No matrix was for spectra acquisition.

Figure 8:
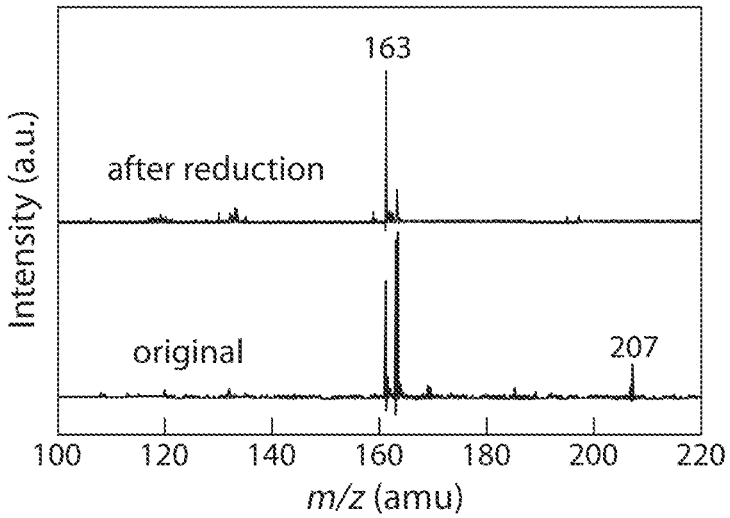
FIG. 8 shows MALDI-TOF spectra of NNK and nicotine mixtures, according to some embodiments.

The results of the analysis are shown in FIG. 8. In particular, FIG. 8 shows MALDI-TOF spectra of the original NNK and nicotine mixture and the same mixture that underwent electrochemical reduction at a reducing potential of -1.5 V for 10 minutes at a pH of about 1 and a temperature of about 25° C. . The initial NNK concentration was 0.4 g/L (1.9 mM), and the initial nicotine concentration was 1 g/L (6.2 mM). The working electrode was hemin-CNT on Toray carbon paper, the reference electrode was Ag/AgCl, and the auxiliary electrode was Pt wire. As a result of the electroreduction, peaks corresponding to the original NNK ions (m/z 207-208 amu) disappeared, whereas peaks at 195 and 197 amu corresponding to deuterium-exchanged hydrazine fragments (FIG. 6) appeared. The results demonstrated that NNK was electroreduced, whereas nicotine stayed intact (m/z 163 amu).

EXAMPLE 4

Figure 9:
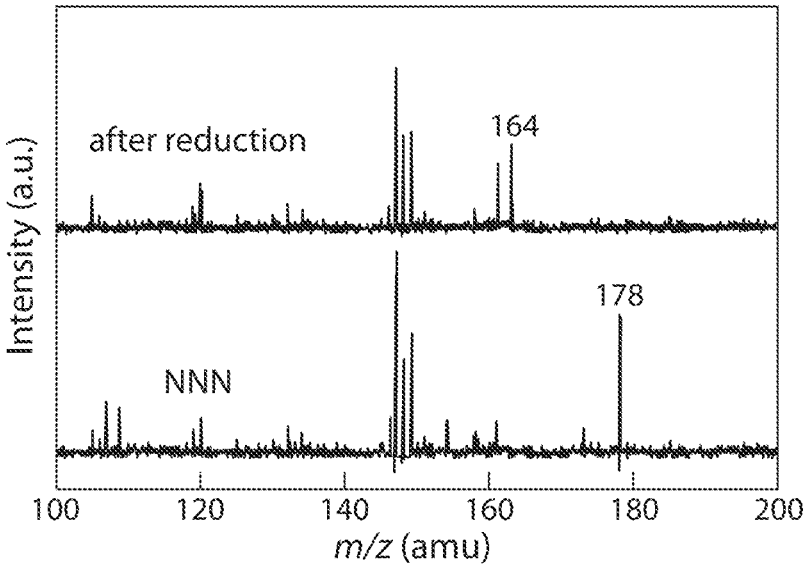
FIG. 9 shows, according to some embodiments, MALDI-TOF spectra of NNN and its products after electrochemical reduction.

In this Example, electroreduction of NNN, a carcinogenic tobacco-specific nitrosamine, in acidic aqueous solutions was demonstrated. An NNN solution was prepared as described in Example 3, with an NNN concentration of 0.2 g/L (1.1 mM) and a pH adjusted to 1.5 by 2 M aqueous HCl. The solution was placed into the electrolyzer and subjected to reducing potential of −1.5 V as described in Examples 1 and 3. Small aliquots of the original mixture and the mixture that underwent the electrochemical reduction were subjected to analysis using MALDI-TOF spectrometry (FIG. 9). Spectrometry demonstrated that the original [NNN+H] ion (m/z 178 amu) was reduced to 2-(pyridin-3-yl)pyrrolidin-1-aminium (m/z 164 amu, see FIG. 10). No NNN signature was detected after electrolytic reduction (i.e., NNN concentration was below sensitivity level). Ion fragments, such as 3-(pyrrolidin-2-yl)pyridin-1-ium (m/z 149 amu), N-methylene-1-(pyridin-3-yl)methaniminium (m/z 119 amu), (pyridin-3-ylmethylidyne)ammonium (m/z 105 amu), were also identified using combinatorial computation and literature data.

FIG. 9 shows MALDI-TOF spectra of NNN and its products after electrochemical reduction for 10 minutes at a constant potential of −1.5 V. The NNN concentration was 0.2 g/L (1.1 mM). The electrolyte was 0.15 M $LiClO_4$ (pH adjusted to 1.5 by HCl). The working electrode was hemin-CNT on Toray carbon paper, the reference electrode was Ag/AgCl, and the auxiliary electrode was Pt wire.

Figure 10:
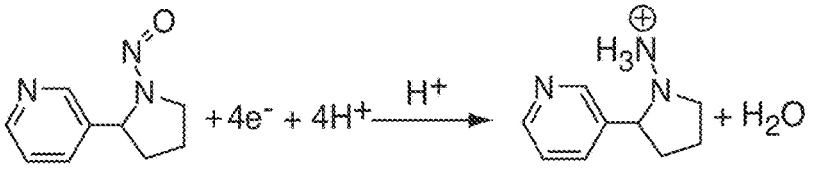
FIG. 10 shows a schematic representation of electroreduction of NNN, according to some embodiments.

FIG. 10 shows an exemplary schematic representation of electroreduction of NNN in acidic solution. Computed m/z values matching data in FIG. 9 are also presented.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

Having thus described several aspects of at least one embodiment, it is to be appreciated that various alterations, modifications, and improvements will readily occur to those skilled in the art. Such alterations, modifications, and improvements are intended to be within the spirit and scope of the present disclosure. Accordingly, the foregoing description and drawings are by way of example only.

Various features and aspects of the present disclosure may be used alone, in any combination of two or more, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the concepts disclosed herein may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc. in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A method for reducing a tobacco-specific nitrosamine, comprising:

contacting an initial electrolyte mixture with an anode and a cathode, wherein the initial electrolyte mixture comprises nicotine, the tobacco-specific nitrosamine, a dissolved salt, and at least one solvent; and applying an electrical potential between the anode and the cathode to form a reduced electrolyte mixture, wherein a concentration of the tobacco-specific nitrosamine in the reduced electrolyte mixture is lower than a concentration of the tobacco-specific nitrosamine in the initial electrolyte mixture.

2. The method of claim 1, further comprising contacting a tobacco composition comprising nicotine and the tobacco-specific nitrosamine with at least one solvent to form a tobacco mixture, wherein the tobacco mixture forms at least part of the initial electrolyte mixture.

3. The method of claim 1, wherein the tobacco-specific nitrosamine is 4-(methylnitrosamino)-1-(3-pyridyl)-1-butanone (NNK) or N-nitrosonornicotine (NNN).

4. The method of 1, wherein the concentration of the tobacco-specific nitrosamine in the initial electrolyte mixture is in a range from about 10 μg/L to about 0.5 g/L.

5. The method of claim 1, wherein the concentration of the tobacco-specific nitrosamine in the reduced electrolyte mixture is about 0.001 g/L or less.

6. The method of claim 1, wherein a difference between the concentration of the tobacco-specific nitrosamine in the initial electrolyte mixture and the concentration of the tobacco-specific nitrosamine in the reduced electrolyte mixture is at least about 0.001 g/L.

7. The method of claim 1, wherein the initial electrolyte mixture and the reduced electrolyte mixture have a nicotine concentration in a range from about 0.01 g/L to about 100 g/L.

8. The method of claim 1, wherein the initial electrolyte mixture has a pH of about 2.0 or less.

9. The method of claim 1, wherein the initial electrolyte mixture and the reduced electrolyte mixture have a temperature between about 20° C. and about 25° C.

10. The method of claim 1, wherein the cathode comprises an electrocatalyst and carbon nanotubes, wherein the electrocatalyst comprises an organometallic complex.

11. The method of claim 10, wherein the organometallic complex is a metal porphyrin complex, a metal phthalocyanine complex, or a metalloenzyme.

12. The method of claim 11, wherein the metal porphyrin complex comprises hemin, iron porphyrin, iron(II)(porphyrinato)(imidazole), a heme protein, or a combination of two or more of the foregoing.

13. The method of claim 11, wherein the organometallic complex comprises iron.

14. The method of claim 11, wherein the metalloenzyme is carbon monoxide dehydrogenase.

15. The method of claim 1, wherein the electrical potential is in a range between about −0.5 V and about −5 V.

16. The method of claim 1, wherein the electrical potential is applied between the anode and the cathode for a time period between about 5 minutes and about 15 minutes.

17. A tobacco substrate comprising the reduced electrolyte mixture formed by the method of claim 1, wherein the reduced electrolyte mixture comprises a reduced species of the tobacco-specific nitrosamine.

18. A smoking article comprising a tobacco substrate, said tobacco substrate comprising the reduced electrolyte mixture formed by the method of claim 1, wherein the reduced electrolyte mixture comprises a reduced species of the tobacco-specific nitrosamine.

19. The method of claim 1, wherein the reduced electrolyte mixture comprises a reduced species of the tobacco-specific nitrosamine.

20. The method of claim 19, wherein the reduced species is an amine or a hydrazine.

* * * * *